United States Patent [19]

Simjian

[11] 4,026,279

[45] May 31, 1977

[54] MASSAGING APPARATUS

[76] Inventor: Luther G. Simjian, 7 Laurel Lane, Greenwich, Conn. 06830

[22] Filed: May 10, 1976

[21] Appl. No.: 684,473

[52] U.S. Cl. ..... 128/44; 128/48; 128/57

[51] Int. Cl.[2] ..... A61H 7/00

[58] Field of Search ..... 128/56, 57, 51, 52, 128/48, 49, 44, 62, 63, 58, 25 R

[56] References Cited

UNITED STATES PATENTS

| | | | |
|---|---|---|---|
| 2,226,881 | 12/1940 | Voiles | 128/25 R |
| 2,256,001 | 9/1941 | Titus | 128/25 R |
| 3,468,305 | 9/1969 | Collomp et al. | 128/57 |

*Primary Examiner*—Lawrence W. Trapp

[57] ABSTRACT

A massaging apparatus comprises a rotatable platform and a massaging means coupled for motion responsive to rotation of the platform. The massaging means is disposed to engage a person positioned on the platform and imparting rotation to the platform by executing a torsional movement. In the described embodiment rotation of the platform causes concomitant counter-rotation of the massaging means.

17 Claims, 5 Drawing Figures

FIG. 1
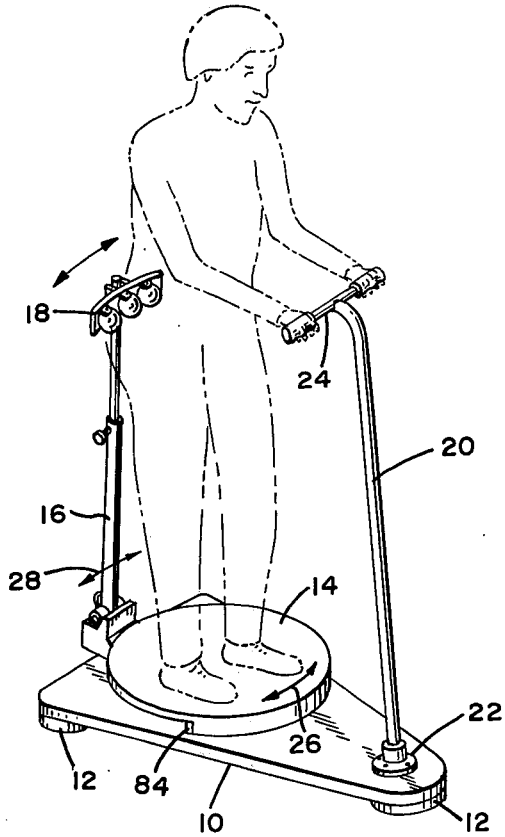
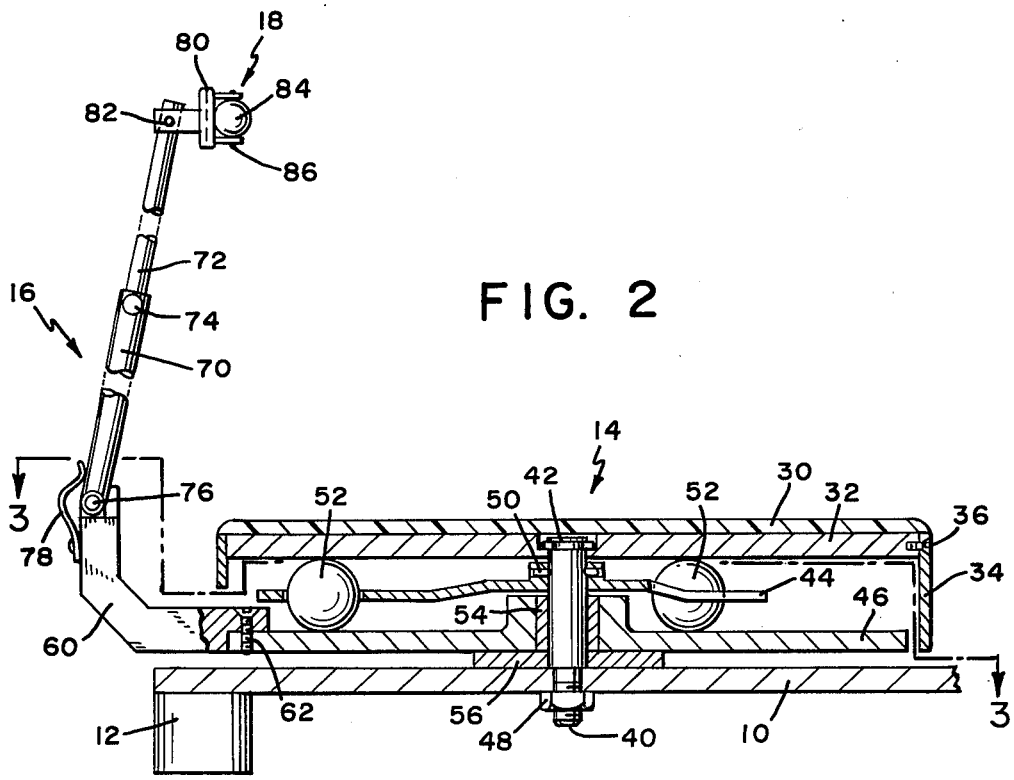
FIG. 2

MASSAGING APPARATUS

BRIEF SUMMARY OF THE INVENTION

This invention refers to a massaging apparatus which is operated responsive to motion imparted to a platform on which a person is disposed. More specifically, this invention refers to a massaging apparatus having a massaging means combined with a rotatable platform which when rotated reciprocatingly by a person disposed on the platform causes the massaging means to provide a massaging action to such person, preferably upon the torso of such person.

In several previous patents I have disclosed the use of an exercise bicycle combined with massaging means, such as U.S. patent application Ser. No. 594,640 filed July 10, 1975, now U.S. Pat. No. 3,960,144 dated June 1, 1976. The instant apparatus combines massaging means with a movable platform which is adapted to support a person in a standing position. Massaging means are disposed to engage the person and are coupled to the platform to move responsive to the motion of the platform. In a preferred mode of operation, the person on the platform imparts to the platform a reciprocating rotational motion and such motion is transmitted to the massaging means to cause the massaging means likewise to undergo a back and forth motion, thereby providing a massaging action which is directly responsive to the motion imparted to the platform.

The motion imparted to the platform is very beneficial for loosening up various body muscles, such as arm, shoulder and stomach muscles, which are the muscles stressed during a golf game. Therefore, the instant apparatus may be used as a conditioning means for sports while deriving the benefits inherent in a body massage.

The present invention will be more clearly apparent from the following description when taken in conjunction with the accompanying drawings.

BRIEF DESCRIPTION OF THE SEVERAL VIEWS OF THE DRAWINGS

FIG. 1 is a perspective view of an embodiment of the massaging apparatus according to the present invention;

FIG. 2 is a vertical, sectional view of the present apparatus;

DETAILED DESCRIPTION

Figure 3:
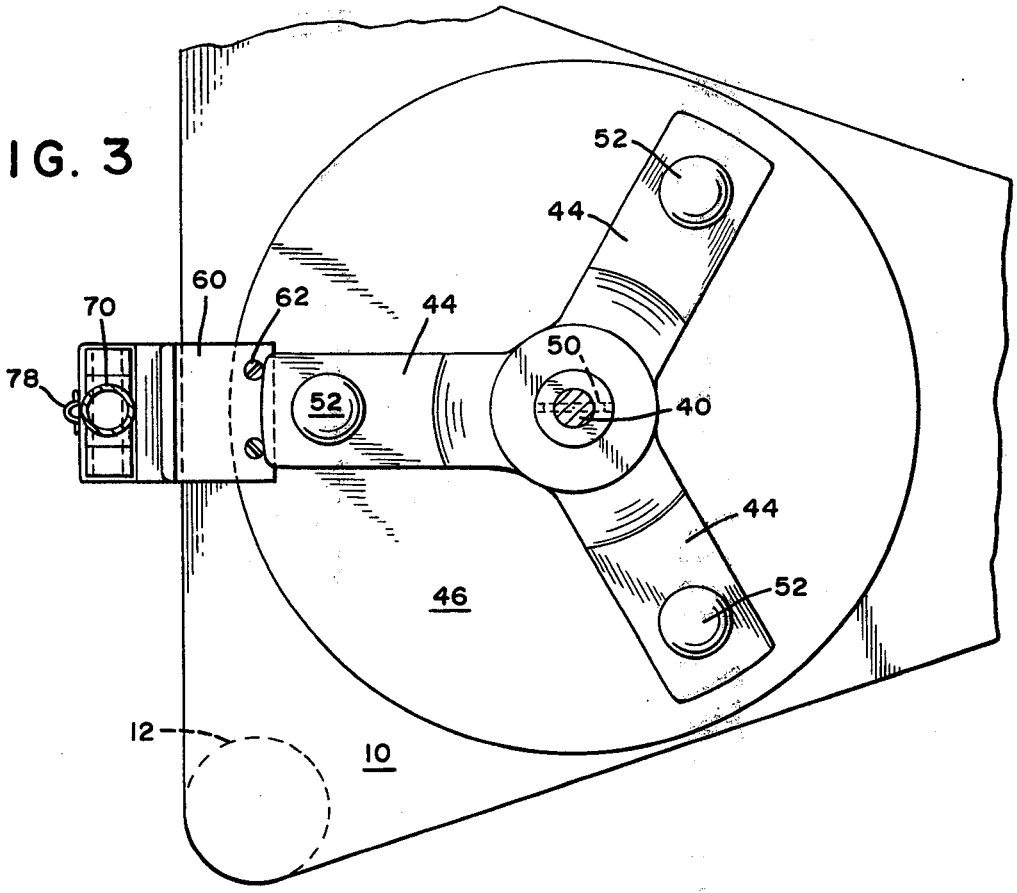
FIG. 3 is a plan view along section line 3—3 in FIG. 2.

Referring now to the figures and FIG. 1 in particular, there is shown a stationary support 10 which rests on a floor or other suitable surface by means of a set of feet 12. The support 10 supports a substantially horizontally disposed rotatable platform 14 upon which a person may stand, such person being shown by dotted lines in FIG. 1. At the rear of the support there extends in an upward direction an arm 16 which carries at its upper end a massaging means 18 which is adapted to engage the person standing on the platform. In front of the platform and extending upwardly from the support 10 there is a bar 20 fastened at its lower end to the support 10 by means of a flange 22 and carrying at its upper end a cross-bar 24 adapted to be gripped by the hands of the person, hence serving as handle means.

Operation of the present device may be visualized as follows: a person stands or otherwise positions himself on the platform 14 and grips the handle means 24. As the person imparts by torsion a reciprocating rotating motion to the platform 14 as indicated by the double-headed arrow 26, the arm 16 having the massaging means 18 undergoes concomitant counter-rotation as shown by the double-headed arrow 28. Both the platform and the arm 16 rotate through an angle of motion which is predetermined by stops as will be seen later. A typical arc of rotation is in excess of 90° and not in excess of 180°. However, such angle selection is arbitrary and no limitation shall be ascribed to the above values.

Referring now to the detailed construction as evidenced by FIG. 2, the platform 14 comprises an upper covering 30 and an underlying plate 32 to which a skirt 34 is affixed by means of screws 36. A centrally located screw 40 has a head 42 which is recessed in the plate 32 and secures together the platform 14, a spider 44, a rotatable plate 46 and the stationary support 10. The nut 48 is tightened upon the screw thread until the screw 40 is under tension so as to prevent the screw 40 from rotating.

The spider 44 is secured to the non-rotating screw 40 by a pin 50 which extends from the hub of the spider through the screw 40. Moreover, the spider is provided with a plurality of rolling members 52, such as bearing balls, in order to transmit motion from the platform 14 (comprising elements 30 and 32) to the rotatable plate 46, causing the plate 46 to rotate about the center axis through the screw 40, but in a direction opposite to that imparted to the platform 14. The plate 46 is provided with a sleeve bearing 54 occupying the space between the hub of the plate 46 and the shank of the screw 40, and a thrust bearing 56 disposed between the underside of the rotatable plate 46 and the upperside of the stationary support 10.

Referring also to FIG. 3, the arm 16, FIG. 1, is fastened to the rotatable plate 46 by means of an L-shaped bracket 60 utilizing a set of screws 62. The bracket 60 extends horizontally outward underneath the platform and then is angled in an upward direction. The arm 16 comprises a set of telescoping tubings 70 and 72, the height of the upper tubing 72 being adjustable by means of a screw 74. The lower end of the tubing 70 is pivotally mounted to the bracket 60 at a pivot 76. A biasing means such as a spring 78 secured with one end to the bracket 60 and engaging with its upper end the tubing 70 urges the massaging means 18 toward the center of the platform 14 and thereby toward engagement with the person on the platform. Alternatively, a spring biased hinge may be substituted for the pivot 76 and spring 78.

The massaging means 18 comprises, in a preferred embodiment, a bracket 80 secured by means of a pivot 82 to the upper tubing 72. The massaging means includes further a plurality of massaging elements 84, each being individually rotatable by being supported upon a respective tubing 86 which extends vertically through the center of a respective massaging element. In a typical embodiment each massaging element 84 is made from hard rubber.

Figure 4:
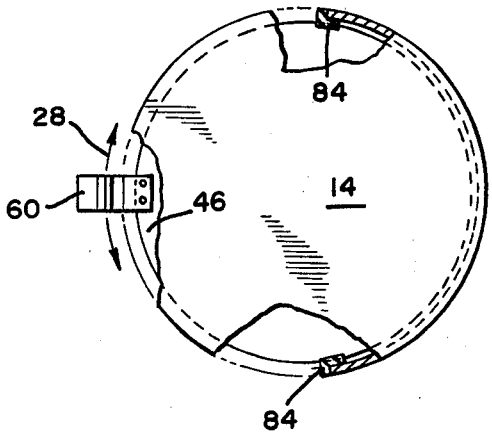
FIG. 4 is a top plan view of a portion of the apparatus.

As clearly seen in FIGS. 2 and 4, the skirt 35 is shortened in such areas where the bracket 60 moves back and forth, that is, undergoes reciprocating rotational motion responsive to the motion imparted to the platform 14 by the person disposed on the platform. In order to avoid a hard impact at the end position, a bumper 84 is affixed to the skirt 34 at the end of the arcuate travel of the arm. It will be apparent that other stopping means may be provided including a ramp, or spring means providing increasing resistance to rotation. In a similar manner, it is possible to bias the platform toward its central position by means of springs and provide for increasing force to effect increasing rotational excursion from this central position. Other bias means as readily understood by those skilled in the art are, of course, usuable also.

Figure 5:
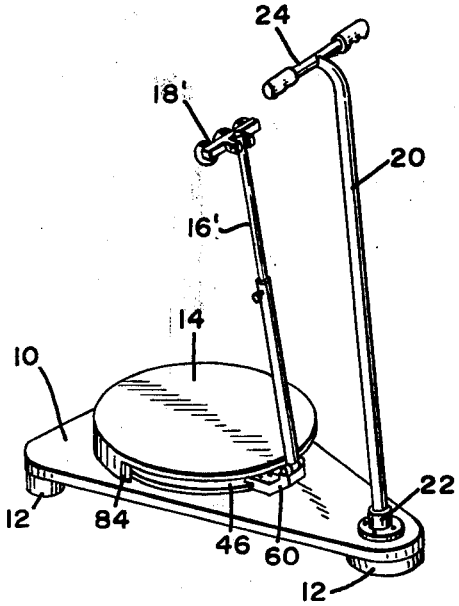
FIG. 5 is an alternative embodiment of the arrangement shown in FIG. 1.

An alternative embodiment is illustrated in FIG. 5 wherein the arm 16' with massaging means 18' is mounted in front of the platform 14 in order to engage the area of the stomach of a person standing on the platform 14. As before, responsive to reciprocating rotational motion of the platform 14, the arm 16' undergoes concomitant motion, but in the opposite direction.

A still further embodiment, not illustrated, contemplates the use of a plurality of arms 16, such as by combining the embodiment per FIG. 1 with that per FIG. 5, to obtain a construction wherein one massaging means engages the front of the person and another massaging means the rear of the person so that a greater area receives a massaging action. Each arm is secured to the plate 46 by a respective bracket 60.

In another modification power means may be used to additionally rotate the massaging elements about their respective centers aside from the motion imparted by the arm.

Whereas the above described construction of the platform 14 and of the associated coupling means 44, 46 and 52 for providing motion to the arm 16 comprises a preferred embodiment of the present invention, it shall be understood that other coupling means may be used also, such as the construction disclosed in my previous U.S. Pat. No. 3,784,193 dated Jan. 8, 1974.

While there has been described and illustrated a preferred embodiment of my invention and several alternative constructions have been described, it will be apparent to those skilled in the art that still further modifications may be made without deviating from the broad principle of my invention which shall be limited only by the scope of the appended claims.

What is claimed is:

1. A massaging apparatus comprising:
a stationary support;
a rotatable platform supported on said support;
a massaging means positioned to engage a body portion of a person disposed upon said platform, and
means coupling said massaging means to said platform for causing said massaging means to move responsive to rotation of said platform to effect a massaging action upon a person on said platform.

2. A massaging apparatus as set forth in claim 1, said means coupling causing said massaging means to move through an angle of rotation responsive to rotation of said platform.

3. A massaging apparatus as set forth in claim 2, said massaging means being caused to counter-rotate relative to the rotation of said platform.

4. A massaging apparatus as set forth in claim 1, said massaging means comprising massaging element means fastened to an upstanding arm.

5. A massaging apparatus as set forth in claim 4, and adjusting means for adjusting the height of said arm.

6. A massaging apparatus as set forth in claim 4, and means disposed for biasing said massaging element means toward the center of said platform.

7. A massaging apparatus as set forth in claim 4, said means coupling comprising a plurality of rolling members disposed for rolling contact between the underside of said platform and a rotatable plate to which said arm is coupled, and means securing said plate to said support.

8. A massaging apparatus as set forth in claim 7, said rolling members being retained in a stationary spider.

9. A massaging apparatus as set forth in claim 4, and hand support means mounted to and extending from said stationary support.

10. A massaging apparatus as set forth in claim 4, said massaging element means disposed for engaging the torso of a person.

11. A massaging apparatus as set forth in claim 2, and means disposed for limiting the rotation of said platform and massaging means.

12. A massaging apparatus comprising:
A. a superposed assembly including:
1. a stationary support;
2. a rotatable plate;
3. a rotatable platform, and
4. a stationary spider having spherical bearing members disposed between said platform and said rotatable plate, said bearing members transmitting motion said platform and said plate;
B. an arm coupled to said rotatable plate and extending upwardly above the elevation of said platform and having at its upper end massaging element means adapted to engage the torso of a person on said platform, and
C. handle means fastened to said support for being grasped by a person disposed on said platform for enabling such person to effect rotation of said platform whereby to cause said arm to counter-rotate and said massaging means to provide a massaging action upon a person standing on said platform.

13. A massaging apparatus as set forth in claim 12, said arm rotating about a central axis which intersects the center of rotation of said platform and said rotatable plate.

14. A massaging apparatus as set forth in claim 13, and biasing means disposed for urging said massaging element means toward the center of said platform.

15. A massaging apparatus as set forth in claim 12, and a further arm coupled to said rotatable plate and extending upwardly above the elevation of said platform and having at its upper end massaging element means also adapted to engage the torso of a respective person on said platform.

16. A massaging apparatus as set forth in claim 12, and means disposed for limiting the rotational excursion of said platform and arm.

17. A massaging apparatus as set forth in claim 12, and means disposed for biasing said platform toward a central position.

* * * * *